United States Patent [19]

Tabatchnik-Michaeli

[11] 4,163,276

[45] Jul. 31, 1979

[54] LIGHTING MEANS, ESPECIALLY HEADLIGHTS OF VEHICLES

[76] Inventor: Baruch Tabatchnik-Michaeli, 33 Derech Eilat, Ramat Gan, Israel

[21] Appl. No.: 812,044

[22] Filed: Jul. 1, 1977

[30] Foreign Application Priority Data

Jul. 4, 1976 [IL] Israel ..... 50206

[51] Int. Cl.[2] ..... F21M 3/14

[52] U.S. Cl. ..... 362/255; 362/189; 362/278; 362/306; 362/364; 362/368; 362/390

[58] Field of Search ..... 362/189, 255, 278, 306, 362/319, 350, 368, 364, 390, 430, 24

[56] References Cited

U.S. PATENT DOCUMENTS

| | | | |
|---|---|---|---|
| 1,538,301 | 5/1925 | Rose | 362/390 X |
| 2,445,072 | 7/1948 | Lee | 362/306 |
| 2,901,654 | 8/1959 | Myers | 362/306 X |
| 2,983,811 | 5/1961 | O'Brian | 362/189 |
| 3,147,927 | 9/1964 | Steele et al. | 362/189 |
| 3,184,591 | 5/1965 | Cibie | 362/61 X |
| 3,654,471 | 4/1972 | Nilsson | 362/320 X |
| 3,757,109 | 9/1973 | Knecht et al. | 362/390 X |
| 3,852,586 | 12/1974 | Goodyer et al. | 362/369 X |

FOREIGN PATENT DOCUMENTS

| | | | |
|---|---|---|---|
| 514499 | 11/1939 | United Kingdom | 362/72 |

*Primary Examiner*—Peter A. Nelson

*Attorney, Agent, or Firm*—Toren, McGeady and Stanger

[57] ABSTRACT

Headlights for vehicles, especially such which are to be subjected to rough treatment have a casing of resilient and yielding material. The casing is cup shaped and near its edge, at the open side of the cup, an annular groove is provided destined to hold a transparent lens like front wall.

5 Claims, 2 Drawing Figures

LIGHTING MEANS, ESPECIALLY HEADLIGHTS OF VEHICLES

BACKGROUND OF INVENTION

The present invention relates to headlights of vehicles which are intended for use in difficult terrain. Such vehicles are mostly those for military use, such as tanks and halftracks which travel at considerable speed over difficult and irregular terrain.

Headlights of such vehicles are of rather complicated construction and comprise usually a metal housing the front of which is formed by a transparent lens-like wall seated in especially shaped, fluid and dust tight packings which latter are seated in appropriate seat grooves in the said casing. Furthermore, in view of the shocks and vibrations to which the headlights on such vehicles are exposed, special shock absorbing means have to be provided, being built into the lamp casing.

OBJECTS OF THE INVENTION

It is the object of the prevent invention to provide a lamp casing (forming the headlight housing) which can dispense with special tightening means, in which the front lens is held without the need of packings and in which no shock-absorbers need to be provided. Incidentally, the exchange of broken lenses is very much facilitated in the new lamp casings.

SHORT SUMMARY OF DISCLOSURE

According to the invention—in its broad aspects—there is provided a lamp casing or headlight housing which is integrally moulded of a resilient and yielding elastomer such as natural or synthetic rubber (which term includes resilient thermoplastics).

The quality of the material from which the new lamp casing is made may be indicated as being between 40 and 90 shore A.

SHORT DESCRIPTION OF ACCOMPANYING DRAWINGS

The invention will now be described with reference to the accompanying drawings in which FIG. 1 is an underneath view and FIG. 2 an elevational, sectional view of the new casing.

DESCRIPTION OF PREFERRED EMBODIMENT

Figure 1:
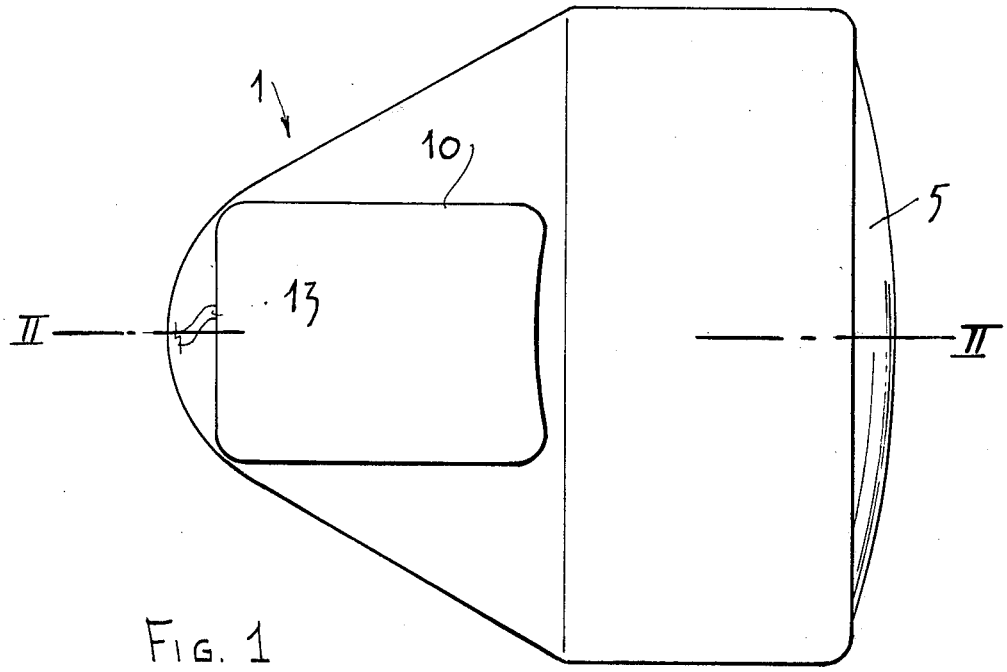
Figure 2:
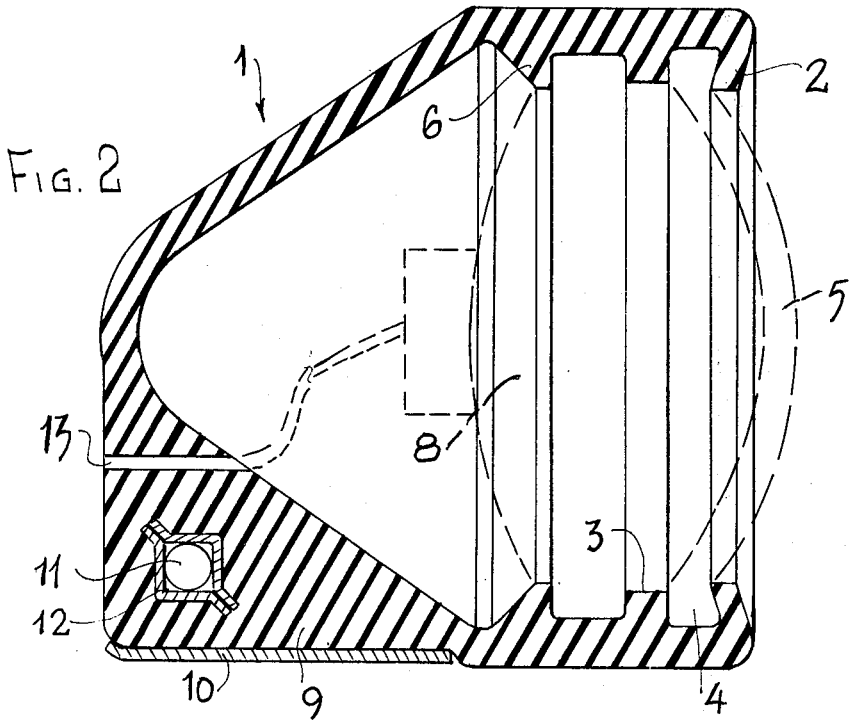

The casing is constituted by a cup-shaped body of generally conventional shape which is integrally moulded from an elastomer, such as rubber (as defined above) and which is designated as a whole by the numeral 1. At its open front the cup 1 has an inwardly extending rim 2 and some distance inwardly a rib 3 is formed in the inner surface of its lateral wall, both rim and rib being circular. Between rim 2 and rib 3 a groove 4 is formed constituting a seat for the lens 5 shown in phantom. Further inwardly another annular rib 6 is provided in the inner surface, defining between it and rib 3 a wide groove 7 which forms the seat for the outer circular edge of a "sealed beam" lamp unit, this latter being indicated as a whole by the numeral 8 and shown in phantom. From the closed rear of the unit 8 conventional electrical leads are passed through the body of cup 1. At the rear of the cup 1, on the lower side of its outer surface, there is provided a solid block like portion 9. This latter is enclosed in a metal holder 10 of U-profile and having triangular side walls. Holder 10 is affixed to portion 9 by a throughgoing screw bolt 11 which pierces the triangular walls. Around the screw bolt 11 extends a tubular structure composed of two flanged angle pieces of metal 12 which safeguards the rubber material of block 9 from being squashed when the screw bolt 11 is tightened. The block-like portion 9 serves to connect the casing to a vehicle or other means.

It will be seen that due to the inherent qualities of the material from which the casing is made, no shock absorbers need be employed. The lens is held in its groove without any packing, the resilient material firmly holding the lens and sealing the interior of the casing against the outside. The conduits leading to the lamp proper are passed through a bore 13 which is made as narrow as possible so that the conduits are forced therethrough, a resilient material then firmly and tightly enclosing the leads. Whenever a lens 5 has to be exchanged, this can easily be done by manually spreading the ring-shaped rim 2 outwardly, setting the new lens into groove 4 and allowing the rim 2 to revert to its holding position.

While the new lamp casing has been described in connection with a "sealed beam" unit, it would be within the scope of the invention to provide a conventional lamp holder and a bulb in the new cup-shaped, resilient housing.

The use of the new lamp casing is not exclusive to land vehicles. It may be used on boats and even on stationery installations where absolute tightness against moisture or otherwise is required.

What I claim is:

1. A casing for lighting means, especially for headlights for vehicles, comprising a cup-shaped body arranged to receive a lighting unit and having an open front end through which the light rays are directed and a closed rear end opposite said front end and an axis extending through said body transversely of said front and rear ends, said body having a continuous annularly shaped lateral wall with an outer surface and an inner surface encircling the axis and extending between said front and rear ends, said lateral wall being closed, said body being integrally molded of a resilient elastomer, the edge of said body defining said open front end comprising an inwardly projecting annular rim completely encircling the axis of said body, a first annular rib formed in the inner surface of the lateral wall of said body completely encircling the axis thereof and spaced from said rim toward the closed rear end, the adjacent surfaces of said rim and said first rib forming a first annular groove for receiving and holding the edge of a lens to be positioned across the open front end of said body, a second annular rib formed in the inner surface of the lateral wall of said body completely encircling the axis thereof and spaced from said first rib toward the closed rear end and said first and second ribs forming therebetween a second annular groove for receiving and holding the edge of a lighting unit to be positioned within said casing, and a block-like extension formed integrally with and extending outwardly from the outer surface of the lateral wall of said body adjacent the rear end thereof for connecting the casing to a vehicle without requiring a connecting member extending from the outer surface through the inner surface of said body, said block-like extension extending in the axial direction of said body from a location rearwardly of said second annular groove toward the rear end of said body and also extending in the circumferential direction of the outer surface of said body for only an angular portion thereof.

2. A casing, as set forth in claim 1, including a bore formed in the closed rear end of said body for receiving a connection for a lighting unit positioned within said cup-shaped body.

3. A casing, as set forth in claim 1, wherein said elastomer comprises a natural rubber.

4. A casing, as set forth in claim 1, wherein said elastomer comprises a synthetic rubber.

5. A casing, as set forth in claim 1, wherein said elastomer comprises a thermoplastic material.

* * * * *